US006357458B2

(12) United States Patent
Tanaka et al.

(10) Patent No.: US 6,357,458 B2
(45) Date of Patent: Mar. 19, 2002

(54) CLEANING APPARATUS AND CLEANING METHOD

(75) Inventors: Hiroshi Tanaka, Kurume; Shinichiro Shimomura, Tosu; Yuji Kamikawa, Kumamoto-ken, all of (JP)

(73) Assignee: Tokyo Electron Limited (JP)

( * ) Notice: Subject to any disclaimer, the term of this patent is extended or adjusted under 35 U.S.C. 154(b) by 0 days.

(21) Appl. No.: 09/833,000

(22) Filed: Apr. 11, 2001

Related U.S. Application Data

(62) Division of application No. 09/250,457, filed on Feb. 16, 1999, now Pat. No. 6,241,827.

(30) Foreign Application Priority Data

Feb. 17, 1998 (JP) ..... 10-051543
Feb. 17, 1998 (JP) ..... 10-051544

(51) Int. Cl.[7] ..... B08B 3/04; B08B 7/04
(52) U.S. Cl. ..... 134/57 R; 134/113; 134/902; 134/18
(58) Field of Search ..... 134/18, 57 R, 134/56 R, 111, 113, 902

(56) References Cited

U.S. PATENT DOCUMENTS 3,964,956 A 6/1976 Snyder
4,033,871 A 7/1977 Wall
6,082,381 A * 7/2000 Kamikawa et al. ..... 134/57 R

FOREIGN PATENT DOCUMENTS

| | | |
|---|---|---|
| JP | 62-32531 | 2/1987 |
| JP | 62-176585 | 8/1987 |
| JP | 63137430 | 6/1988 |
| JP | 02243784 | 9/1990 |
| JP | 04278529 | 10/1992 |
| JP | 08120462 | 5/1996 |

* cited by examiner

*Primary Examiner*—Zeinab El-Arini
(74) *Attorney, Agent, or Firm*—Morrison & Foerster LLP

(57) ABSTRACT

Wafers (W) is immersed in a cleaning liquid (L) contained in a cleaning tank (20). The cleaning liquid (L) is supplied into the cleaning tank (20) so that the cleaning liquid (L) overflows the cleaning tank (20). The cleaning liquid (L) overflowed the cleaning tank (20) is filtered, circulated and returned into the cleaning tank (20). A motor-operated bellows pump (30) is connected by a suction pipe (51) to the cleaning tank (20). A particle counter (5) for counting particles contained in a sample of the cleaning liquid (L) sampled by the motor-operated bellows pump (30) is placed on the suction pipe (51) and connected to the suction side of the motor-operated bellows pump (30).

10 Claims, 10 Drawing Sheets

APPROVED BY DRAFTSMAN G. Z. CLASS 721 SUBCLASS 93

08/923,414

FIG.1

26

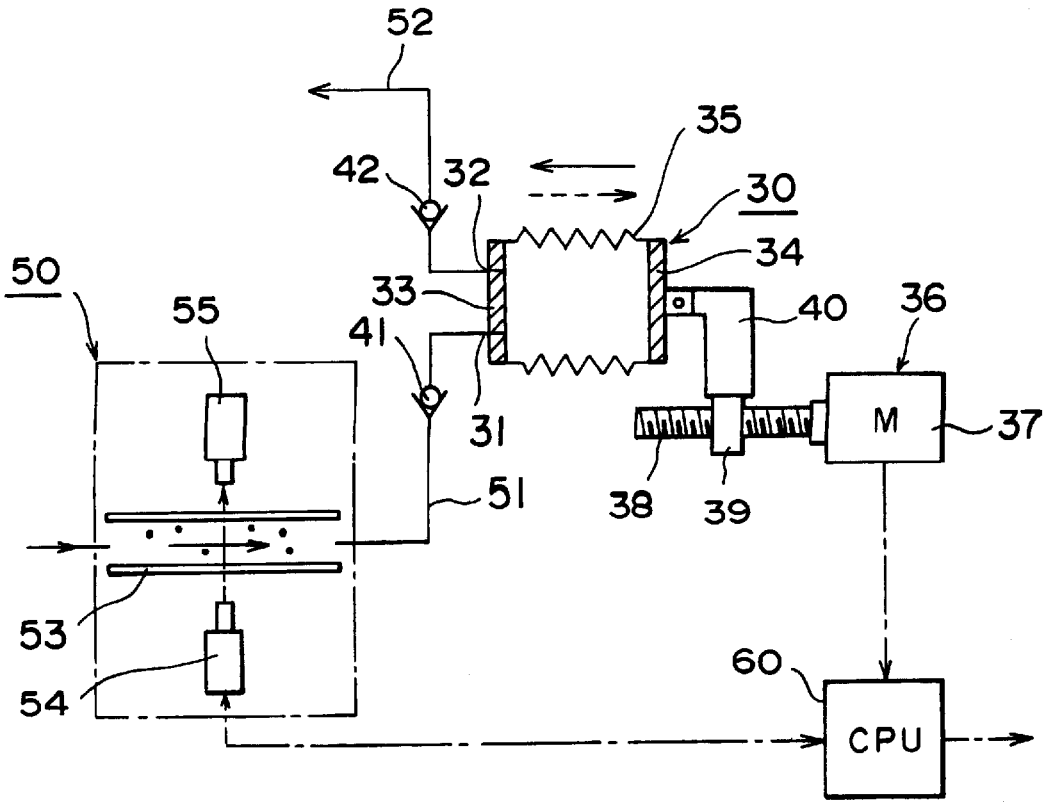
FIG. 3
FIG. 4(a)
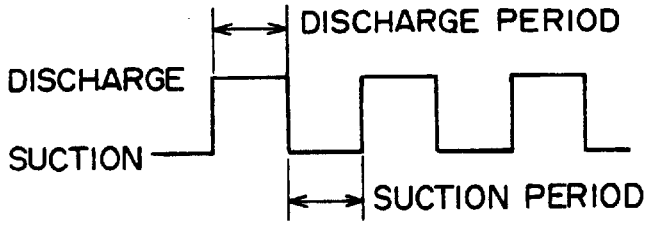
FIG. 4(b)
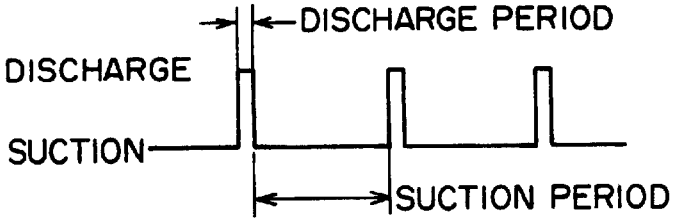

CLEANING APPARATUS AND CLEANING METHOD

This is a divisional application of application Ser. No. 09/250,457, filed Feb. 16, 1999 in the United States on Jun. 5, 2001, now U.S. Pat. No. 6,241,827, from which a foreign priority filing date of Feb. 17, 1998 is claimed.

BACKGROUND OF THE INVENTION

1. Field of the Invention

The present invention relates to a cleaning apparatus for cleaning workpieces, such as semiconductor wafers or glass substrate for LCDs.

2. Description of the Related Art

Generally, a cleaning apparatus is employed prevalently in a semiconductor device fabricating process. The cleaning apparatus carries workpieces, such as semiconductor wafers or glass substrate for LCDs, (hereinafter referred to as "wafers") sequentially to cleaning tanks respectively containing chemical liquids and rinsing liquids for cleaning and the like. A known cleaning apparatus shown in FIG. 13 has a cleaning tank c having an inner tank a containing a cleaning liquid L in which wafers W are immersed and an outer tank b surrounding an upper end part of the inner tank a. A circulation line f connecting cleaning liquid supply nozzles d disposed in a lower part of the inner tank a and a drain port e formed in a bottom wall of the outer tank b is provided, for example, with an air bellows circulating pump g, a damper h and a filter i. Wafers W held on a wafer boat j are immersed in the cleaning liquid L contained in the inner tank a of the cleaning apparatus, the cleaning liquid L is supplied from a cleaning liquid source into the inner tank a so that the cleaning liquid L overflows the inner tank a into the outer tank b. The cleaning liquid L overflowed into, the outer tank b is filtered and circulated. The wafers W are thus cleaned.

As the cleaning liquid is used repeatedly, contaminative particles, such as particles removed from the wafers W, are accumulated in the cleaning liquid. The wafers subjected to cleaning in the cleaning liquid are contaminated, the yield of the cleaning process is reduced and the cleaning performance of the cleaning apparatus is reduced if the particle concentration of the cleaning liquid exceeds a predetermined level.

As shown in FIG. 13, a branch line k for quality testing is connected to a part of the circulation line f on the discharge side of the circulating pump g, a testing means, for example, a particle counter m, is connected to the branch line k, and the discharge side of the particle counter m is connected to the outer tank b. A portion of the cleaning liquid L contained in the inner tank a is sampled and the number of particles contained in the sample cleaning liquid is measured to monitor the number of particles contained in the predetermined quantity of cleaning liquid L. In FIG. 13, indicated at n is a shutoff valve placed in the circulation line f, at p is a drain pipe connected to a drain port q formed in the bottom wall of the inner tank a, and at r is a drain valve placed in the drain pipe q.

Since the circulating pump g is of an air bellows type, the flow rate of the sample cleaning liquid is unstable and, consequently, accurate measurement of particles cannot be achieved. Since the circulating pump g serves also as means for supplying the cleaning liquid to the particle counter m, the cleaning liquid is supplied at a flow rate exceeding the ability of the particle counter m. Furthermore, since the measurement of particles uses the sample cleaning liquid sampled at a part of the circulation line f on the discharge side of the circulating pump g, the particle counter m adds the number of particles produced by the circulating pump g to the number of particles originally contained in the cleaning liquid and, consequently, the number of particles originally contained in the cleaning liquid cannot accurately be measured.

SUMMARY OF THE INVENTION

The present invention has been made in view of the foregoing problems and it is therefore an object of the present invention to provide a cleaning apparatus capable of accurately measuring fine contaminative particles, such as particles contained in a cleaning liquid, of operating at an improved yield and of exercising improved cleaning performance, and to provide a cleaning method to be carried out by the cleaning apparatus.

The foregoing object can be achieved by the followings.

According to one aspect of the present invention, a cleaning apparatus comprises a cleaning tank for containing a cleaning liquid in which workpieces are immersed for processing, a circulation line connected to the cleaning tank and provided with a filtering device, and a measuring line separate from the circulation line, provided with a fixed-quantity delivery means and a measuring means for measuring fine contaminative particles, such as particles, contained in the cleaning liquid and having a suction end connected to the cleaning tank.

In the cleaning apparatus of the present invention, the measuring means may be connected to the suction side of the fixed-quantity delivery means.

In the cleaning apparatus of the present invention, the measuring means may be connected to the discharge side of the fixed-quantity delivery means.

The measuring means is able to measure fine contaminative particles, such as particles, contained in the cleaning liquid accurately because a fixed quantity of the cleaning liquid can be taken out from the cleaning tank.

The cleaning apparatus of the present invention may be provided with a control means for synchronously operating the fixed-quantity delivery means and the measuring means.

The control means makes the measuring means carry out a measuring operation while the fixed-quantity delivery means is in suction operation.

A fixed quantity of the cleaning liquid can be sampled from the cleaning tank and the measuring means is able to achieve the accurate measurement of the fine contaminative particles, such as particles, contained in the cleaning liquid. The synchronous operation of the fixed-quantity delivery means and the measuring means improves measuring accuracy.

In the cleaning apparatus, the discharge end of the measuring line may be connected to the cleaning tank.

When the discharge end of the measuring line is connected to the cleaning tank, the sample cleaning liquid can be returned to the cleaning tank for the effective use of the cleaning liquid.

In the cleaning apparatus of the present invention, the cleaning tank may have an inner tank in which workpieces are immersed in the cleaning liquid, and an outer tank for containing the cleaning liquid overflowed the inner tank, and the suction side of the measuring line may be connected to the inner tank.

When the cleaning apparatus is thus constructed, a fixed quantity of the cleaning liquid contained in the inner tank in which workpieces are immersed in the cleaning liquid can be sampled and fine contaminative particles, such as particles, contained in the cleaning liquid can accurately be measured by the measuring means.

In the cleaning apparatus of the present invention, the discharge side of the measuring line may be connected to the outer tank.

When the discharge side of the measuring line is connected to the outer tank, the sample cleaning liquid subjected to measurement can be discharged into the outer tank instead of directly returning the same into the inner tank in which the workpieces are immersed in the cleaning liquid. Accordingly, the cleaning ability of the cleaning liquid is not reduced and the cleaning liquid can be circulated for the effective use of the same.

In the cleaning apparatus the present invention, the fixed-quantity delivery means may be a motor-operated bellows pump comprising a corrosion-resistant and chemical-resistant bellows, and a ball screw mechanism for driving the bellows.

The use of the chemical-resistant, durable motor-operated bellows pump capable of pumping a fixed quantity of the cleaning liquid extends the life of the apparatus, and improves measuring accuracy and the reliability of the apparatus.

In the cleaning apparatus of the present invention, the fixed-quantity delivery means may comprise a plurality of motor-operated bellows pumps arranged in parallel and the bellows pumps may be driven so that the bellows pumps operate in different phases, respectively.

When the motor-operated bellows pumps excellent in ability to pump a fixed quantity of fluid, chemical resistance and durability are employed the fixed-quantity delivery means, the life of the apparatus can be extended, measuring accuracy can be improved, the reliability of the apparatus can be enhanced, and fine contaminative particles, such as particles, contained in the cleaning liquid can accurately and continuously be measured.

In the cleaning apparatus of the present invention, the control means may provide a detection signal when the contaminative particle number of the cleaning liquid determined on the basis of measured data provided by the measuring means exceeds a predetermined upper limit value.

According to another aspect of the present invention, a cleaning method which immerses workpieces in a cleaning liquid contained in a cleaning tank and circulates the cleaning liquid contained in the cleaning tank through a circulation line provided with a filtering device for filtering the cleaning liquid comprises a step of sampling a fixed quantity of the cleaning liquid from the cleaning tank by a fixed-quantity delivery means, a step of measuring fine contaminative particles contained in the cleaning liquid sampled by the fixed-quantity delivery means by a measuring means, and a step of providing a detection signal representing the contaminative particle number of the cleaning liquid determined on the basis of measured data measured by the measuring means by a control means.

The control means of the present invention may provide a cleaning liquid change request signal when the contaminative particle number of the cleaning liquid on the basis of measured data provided by the measuring means exceeds a predetermined upper limit value.

The control means of the present invention may compare the contaminative particle number of the cleaning liquid sampled before a start of a first cleaning cycle and that of the cleaning liquid sampled after the completion of a cleaning cycle, and may provide the detection signal when a differential particle number between the respective contaminative particle numbers of the cleaning liquids, exceeds a predetermined upper limit value.

The control means of the present invention may provide an abnormal workpiece signal when the contaminative particle number on the basis of the measured data provided by the measuring means exceeds a predetermined upper limit value.

According to the present invention, a fixed quantity of the cleaning liquid can be sampled from the cleaning liquid contained in the cleaning tank at a sampling position other than the circulation line before staring a cleaning process or during a cleaning process, and the quantity of contaminative particles contained in the cleaning liquid is measured. Therefore, contaminative particles contained in the cleaning liquid can accurately be measured, and it is possible to inform the operator of an inappropriate condition of the cleaning liquid by a detection signal indicating the quantity of contaminative particles exceeding a predetermined upper limit value. It is also possible to inform the operator that the quantity of contaminative particles contained in the cleaning liquid is not greater than the predetermined upper limit value and the normal cleaning process can be achieved.

The cleaning method of the present invention may further comprise a step of cleaning workpieces by immersing the same in the cleaning liquid contained in the cleaning tank after it is decided on the basis of a detection signal provided by the control means that the cleaning liquid is appropriate to cleaning.

According to the present invention, the ability and the yield of the cleaning process can be improved by cleaning the workpiece after it is decided that the measured quantity of contaminative particles is not greater than the predetermined upper limit value indicating the upper limit of the quantity of contaminative particles for the cleaning liquid appropriate to cleaning.

The cleaning method of the present invention may further comprise a step of changing the cleaning liquid when the cleaning liquid change request signal is provided continuously by the control means for a time exceeding a predetermined time.

According to the present invention, the cleaning liquid is changed if the quantity of contaminative particles does not decrease below the predetermined-upper limit value in the predetermined time. Therefore, the ability and the yield of the cleaning process can be improved.

The cleaning method of the present invention may further comprise a step of changing the cleaning liquid when a differential particle number between the measured contaminative particle number of the cleaning liquid sampled before a start of a first cleaning cycle and that of the cleaning liquid sampled after the completion of a cleaning cycle exceeds a predetermined upper limit value.

According to the present invention, the cleaning ability of the cleaning liquid is improved and the yield can be improved because the cleaning liquid is changed when the differential particle number, i.e., the difference between the measured contaminative particle number of the cleaning liquid sampled before the start of the first cleaning cycle and that of the cleaning liquid sampled after the completion of the cleaning cycle, exceeds the predetermined upper limit value.

The cleaning method of the present invention may further comprise a step of comparing the measured contaminative particle concentration of the cleaning liquid sampled before a start of a cleaning cycle and that of the cleaning liquid sampled after the completion of the cleaning cycle, and providing the detection signal when a differential particle number between the respective contaminative particle numbers of the cleaning liquid, exceeds a predetermined upper limit value by the control means, and changing the cleaning liquid when the detection signal is provided by the control means.

According to the present invention, the cleaning ability of the cleaning liquid is improved and the yield can be improved because the cleaning liquid is changed when the differential particle number, i.e., the difference between the measured contaminative particle number of the cleaning liquid sampled before the start of the cleaning cycle and that of the cleaning liquid sampled when the completion of a cleaning cycle, exceeds the predetermined upper limit value.

The cleaning method of the present invention may change the cleaning liquid after the cleaning liquid has been used for a predetermined number of cleaning cycles or for a predetermined time.

According to the present invention, the cleaning ability of the cleaning liquid is improved and the yield can be improved because the cleaning liquid is changed when the same has been used for the predetermined number of cleaning cycles on the basis of experimental data or for the predetermined time determined on the basis of experimental data.

BRIEF DESCRIPTION OF THE DRAWINGS

FIG. 3 is a schematic sectional view of a fixed-quantity delivery pump and a particle counter included in the cleaning apparatus shown in FIG. 2;

FIGS. 4(*a*) and 4(*b*) are diagrams of assistance in explaining the operating modes of the fixed-quantity delivery pump;

DESCRIPTION OF THE PREFERRED EMBODIMENTS

First Embodiment

Figure 1:
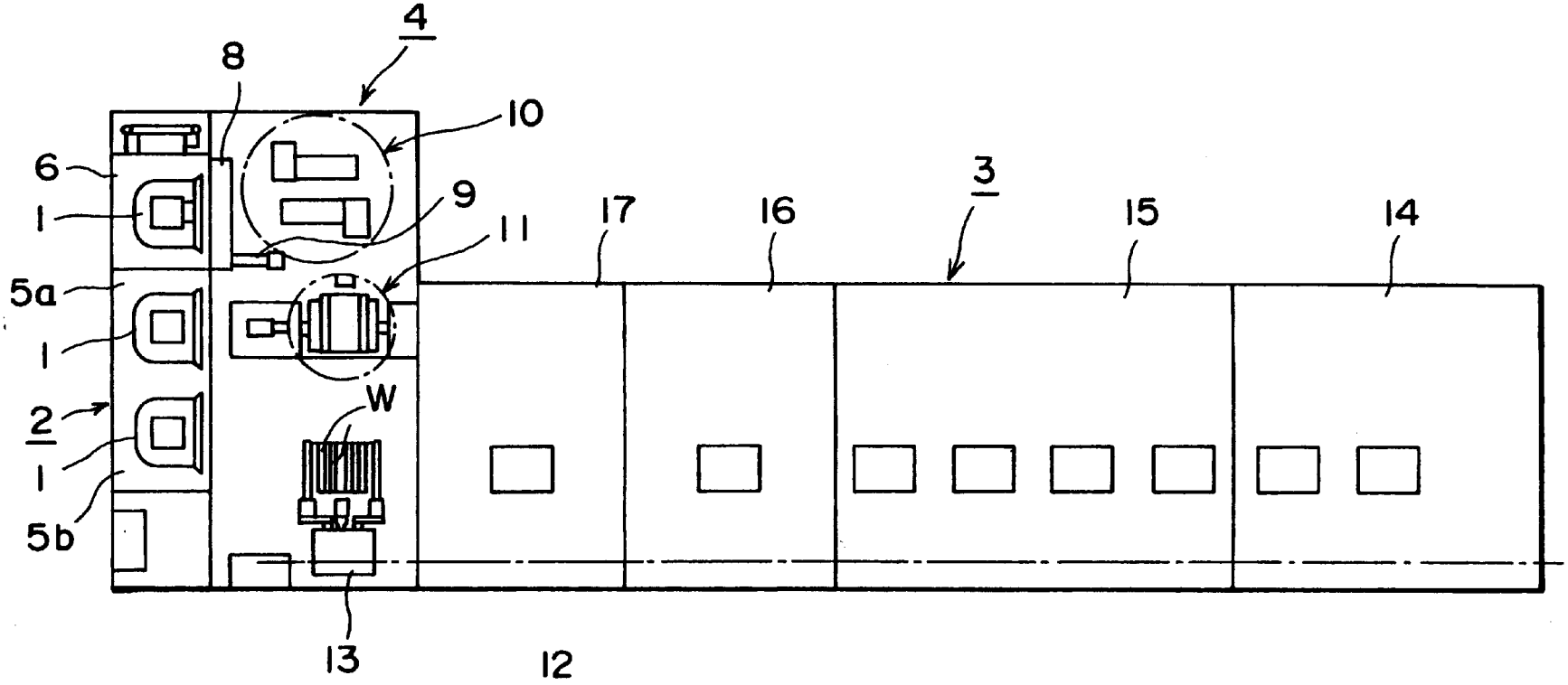
FIG. 1 is a schematic plan view of a cleaning system to which a cleaning apparatus in a first embodiment according to the present invention is applied.

A cleaning apparatus in a first embodiment according to the present invention will be described as applied to a semiconductor wafer cleaning system. Referring to FIG. 1, a cleaning system comprises, as principal components, a conveying section 2 for conveying a carrier 1 holding semiconductor wafers (workpieces) (hereinafter referred to simply as "wafers") in a horizontal position, i.e., a wafer container, a wafer processing section 3 for processing the wafers W in a chemical liquid and a cleaning liquid and drying the same, and a wafer handling section 4 interposed between the conveying section 2 and the processing section 3 for transferring wafers W from the conveying section 2 to the processing section 3 and vice versa, adjusting the position of wafers W and changing the position of wafers W.

The conveying section 2 has a carrier receiving unit 5*a*, a carrier delivering unit 5*b* and a wafer transfer unit 6, which are disposed at one end of the cleaning system. A conveying mechanism, not shown, is disposed between the carrier receiving unit 5*a* and the wafer transfer unit 6 to convey the carrier 1 from the carrier receiving unit 5*a* to the wafer transfer unit 6.

Carrier lifters, not shown, are installed in the carrier receiving unit 5*a* and the wafer transfer unit 6, respectively. The lifters deliver empty carriers 1 to and receive the same from a carrier storage unit, not shown, disposed above the conveying section 2. A transfer robot, not shown, capable of moving in horizontal directions, i.e., directions along an X- and a Y-axis, and vertical directions, i.e., directions along a Z-axis is installed in the carrier storage unit The transfer robot arranges empty carriers 1 received from the wafer transfer unit 6 and carries empty carriers 1 to the wafer transfer unit 6. Loaded carriers 1 containing wafers W also can be stored in the carrier storage unit.

The wafer transfer unit 6 has an opening opening into the wafer handling section 4, and a lid operating device 8 is disposed in the opening of the wafer transfer unit 6. The lid operating device 8 removes a lid, not shown, from a carrier 1 and put the same on the carrier 1. The lid of a loaded carrier 1 loaded with unprocessed wafers W can be removed by the lid operating device 8 to carry the wafers W out of the carrier 1, and the lid can be put on the empty carrier 1 after all the wafers W have been carried out of the carrier 1. The lid of an empty carrier 1 transferred from the carrier storage unit to the wafer transfer unit 6 can be removed by the lid operating device 8, and the lid can be put on the carrier 1 after the carrier 1 has been loaded with wafers W. A mapping sensor 9 is disposed near the opening of the wafer transfer unit 6 to count the number of wafers W contained in a carrier 1.

Installed in the wafer handling section 4 are a wafer transfer arm 10, i.e., a horizontal conveying means, for receiving wafers W from the wafer transfer unit 6 and returning wafers W to the wafer transfer unit 6, a pitch changing mechanism, not shown, for holding a plurality of wafers W, such as fifth wafers W, in a horizontal position at predetermined intervals, a position changing mechanism 11 (position changing means) disposed between the wafer transfer arm 10 and the pitch changing mechanism to change a plurality of wafers W, such as twenty-five wafers W, from a horizontal position to a vertical position and vice versa, and a notch aligner (notch detecting means), not shown, for detecting notches, not shown, formed in wafers W held in a vertical position. The wafer handling section 4 has a conveying path 12 extended along the processing section 3. Wafer conveying devices 13 (wafer conveying means) travel along the conveying path 12.

The processing section 3 comprises a first processing unit 14 for removing particles and organic contaminants from wafers W, a second processing unit 15 for removing metallic contaminants from wafers W, a cleaning unit 16 for removing a chemical oxide film formed on wafers W and drying wafers W, and a cleaning unit 17 for cleaning the wafer conveying device 13, which are arranged in a straight row. A cleaning apparatus in accordance with the present invention is applied to each of the first processing unit 14, the second processing unit 15 and the cleaning unit 17. The wafer conveying devices 13 are disposed in sections of the conveying path 12 corresponding to the units 14, 15, 16 and 17, respectively. Each wafer conveying device 13 is capable of moving in capable of moving in horizontal directions, i.e., directions along an X- and a Y-axis, and vertical directions, i.e., directions along a Z-axis, and of tuning about a θ-axis.

Figure 2:
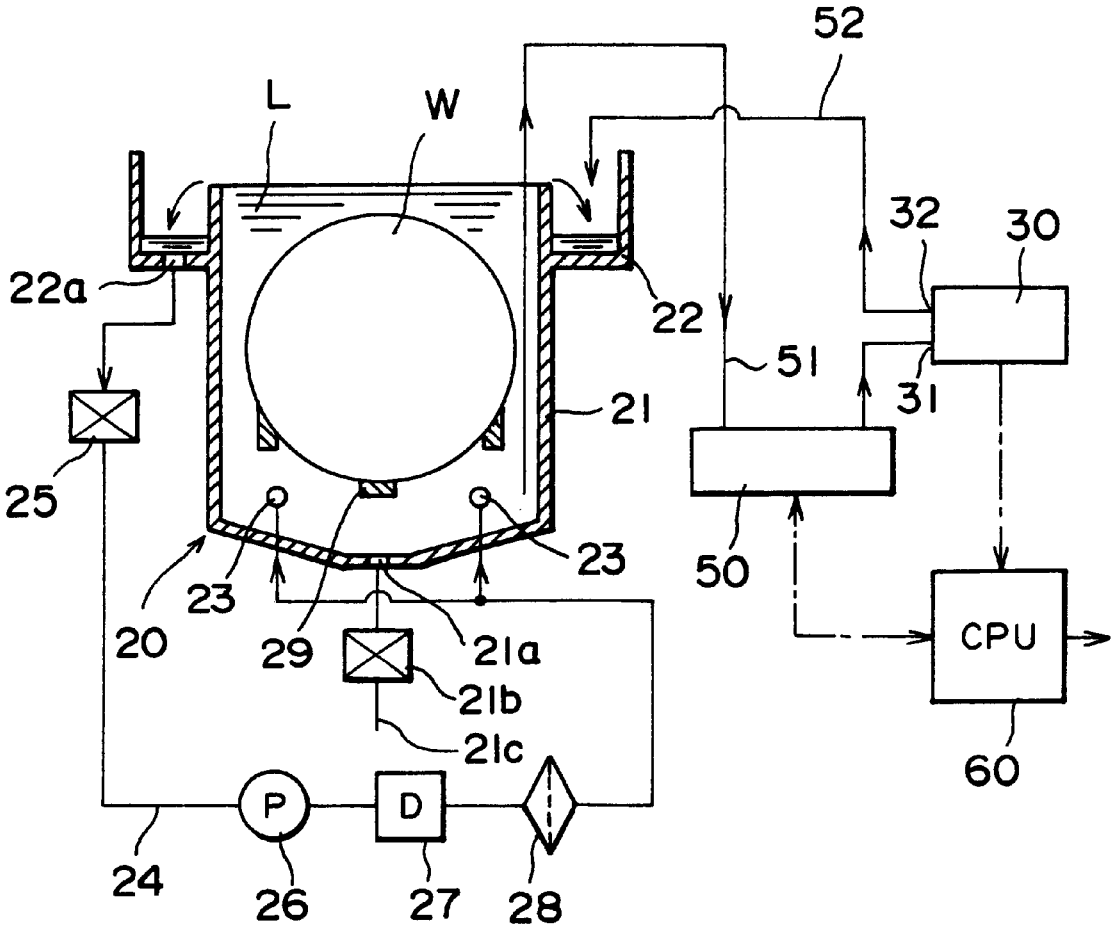
FIG. 2 is a schematic sectional view of the cleaning apparatus employed in the cleaning system shown in FIG. 1.

The cleaning apparatus in the first embodiment according to the present invention will be described hereinafter. Referring to FIG. 2, the cleaning apparatus comprises a cleaning tank 20 having an inner tank 21 containing a cleaning liquid, such as diluted hydrofluoric acid solution (DHF) prepared by diluting hydrofluoric acid (HF) in a rinsing liquid, such as pure water, and an outer tank 22 surrounding an upper open part of the inner tank 21 to contain the cleaning liquid L overflowing from the inner tank 21, cleaning liquid supply nozzles 23 disposed in a lower part of the inner tank 21, a circulation pipe 24 connecting the cleaning liquid supply nozzles 23 and a drain port 22*a* formed in the bottom wall of the outer tank 22, and a shutoff valve 25, an air bellows circulating pump 26, a damper 27 and a filter 28 arranged in that order from the side of the drain port 22*a* toward the cleaning liquid supply nozzles 23 on the circulation pipe 24. A wafer boat 29 capable of holding, for example, fifth wafers W is disposed in the inner tank 20 of the cleaning tank 20. A drain pipe 21*c* provided with a drain valve 21*b* is connected to a drain port 21*a* formed in the bottom wall of the inner tank 21. The circulation pipe 24, and the shutoff valve 25, the circulating pump 26, the damper 27 and the filter 28 placed on the circulation pipe 24 constitute a circulation line.

The cleaning apparatus is provided with, in addition to the circulating pump 26 placed on the circulation pipe 24, a motor-operated bellows pump (hereinafter referred to as "fixed-quantity delivery pump") 30. The fixed-quantity delivery pump 30 has a suction port 31 connected by a suction pipe 51 to the inner tank 21, and a discharge port 32 connected by a discharge pipe 52 to the outer tank 22. A particle counter (measuring means) 50 for measuring fine contaminative particles contained in the cleaning liquid L sucked from the inner tank 21 by the fixed-quantity delivery pump 30 is placed on the suction pipe 51. A central processing unit (abbreviated to "CPU") (control means) 60 controls the particle counter 50 so as to operate in synchronism with the sucking operation of the fixed-quantity delivery pump 30. Upon the detection of the actuation of the fixed-quantity delivery pump 30, the CPU 60 actuates the particle counter 50 to measure the quantity (particle number per milliliter) of particles contained in the cleaning liquid L while a sample cleaning liquid is being sampled from the cleaning liquid L contained in the inner tank 21. The CPU 60 provides a detection signal on the basis of the output signal of the particle counter 50. For example, the CPU 60 provides an alarm as a detection signal and displays an alarm or the like when the quantity (particle number) of the particles is greater than a predetermined thresh value.

The suction pipe 51, the discharge pipe 52, the fixed-quantity delivery pump 30 and the particle counter 50 form a measuring line.

As shown in FIG. 3, the fixed-quantity delivery pump 30 has a stationary end member 33 provided with a suction port 31 and a discharge port 32, a movable end member 34 disposed opposite to the stationary end member 33, a bellows 35 made of a corrosion-resistant, chemical-resistant synthetic rubber and extended between the stationary end member 33 and the movable end member 34, and a ball screw mechanism 36 for moving the movable end member 34 toward and away from the stationary end member 33. A threaded rod 38 is linked through a plurality of steel balls to a nut 39, and the nut 39 is connected to the movable end member 34 by a connecting member 40. The threaded rod 38 is driven for rotation by a reversible stepping motor 37 to suck a fixed quantity (for example, 40 ml) of the cleaning liquid L from the inner tank 21 by making the bellows 35 expand and to discharge the sucked cleaning liquid L into the outer tank 22 by making the bellows 35 contract. Check valves 41 and 42 are placed in an end part of the suction pipe 51 connected to the suction port and in an end part of the discharge pipe 52 connected to the discharge port, respectively.

As shown in FIG. 3, the particle counter 50 has a wholly or partly transparent measuring pipe 53 placed in the suction pipe 51, a laser light source 54 capable of emitting a laser beam and disposed on one side of the measuring pipe 53, and a photodetector 55 disposed on the other side of the measuring pipe 53 opposite to the laser light source 54.

The fixed-quantity delivery pump 30 is driven to suck a quantity of the cleaning liquid L from the inner tank 21 and, at the same time, the particle counter 50 is operated. The laser light source 54 emits a laser beam to irradiate the cleaning liquid L flowing through the measuring pipe 53 at a flow rate of 40 ml/min at the maximum. Deflection and interception of the laser beam by fine contaminative particles contained in the cleaning liquid L are detected by the photodetector 55 to count the number of particles contained in a predetermined quantity of the cleaning liquid L to determine the number of particles per milliliter (particles/ml). If the output shaft of the stepping motor 37 is operated in the normal and the reverse direction at the same rotating speed, a suction period, i.e., a time necessary for a suction stroke, and a discharge period, i.e., a time necessary for a discharge stroke, are equal to each other and the measuring operation of the particle counter 50 is interrupted while the bellows 35 is in a discharge stroke as shown in FIG. 4(*a*). However, since the suction period and the discharge period are only a few seconds, the measurement of the particles is not affected by the interruption of the measuring operation of the particle counter 50. The time of the measuring operation of the particle counter 50 can be increased and the time of interruption of the measuring operation of the particle counter 50 can be reduced by driving the output shaft of the stepping motor 37 at a low rotating speed for the suction stroke of the bellows and at a high rotating speed for the discharge stroke of the bellows 35 as shown in FIG. 4(*b*).

Figure 5:
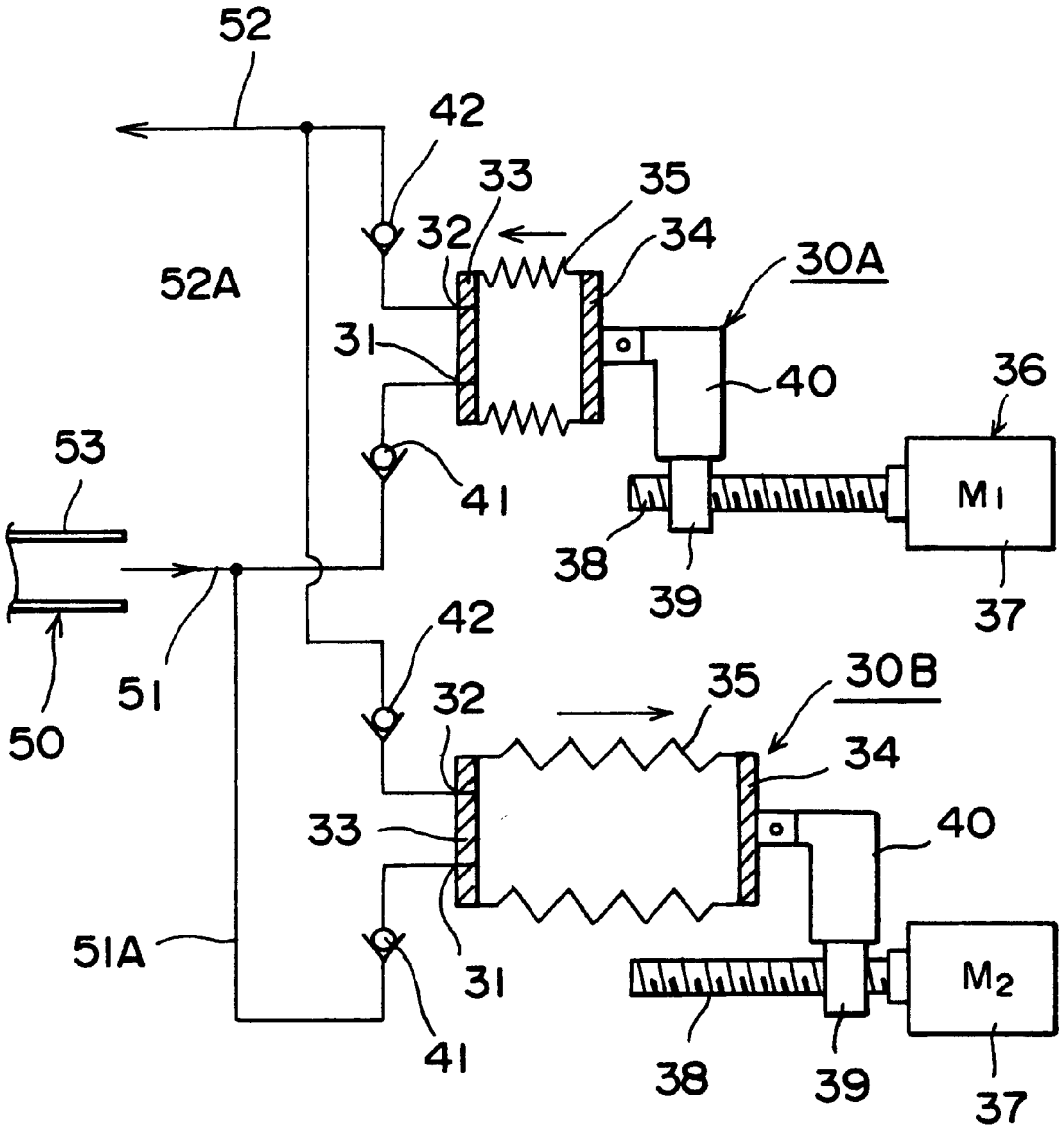
FIG. 5 is a fragmentary schematic view of a cleaning apparatus in a modification of the cleaning apparatus shown in FIG. 2, provided with two fixed-quantity delivery pumps.

The particle counter 50 can continuously be operated by providing the cleaning apparatus with a measuring line comprising the particle counter 50 and two fixed-quantity delivery pumps 30A and 30B connected in a parallel to the particle counter 50 as shown in FIG. 5. The two fixed-quantity delivery pumps 30A and 30B are connected in parallel to the suction pipe 51 and the discharge pipe 52 and are operated in different phases, respectively; that is, the fixed-quantity delivery pump 30A is driven for a discharge stroke while the other fixed-quantity delivery pump 30B is driven for a suction stroke, whereby the particle counter 50 is able to operate for the continuous measurement of particles contained in a predetermined quantity of the cleaning liquid L flowing through the measuring pipe 53.

The configuration of the measuring line shown in FIG. 5 is the same as that of the measuring line shown in FIG. 3, except that the fixed-quantity delivery pump 30A is connected to the suction pipe 51 and the discharge pipe 52, and the other fixed-quantity delivery pump 30B is connected to a branch suction pipe 51A connected to the suction pipe 51, and a branch discharge pipe 52A connected to the discharge pipe 52 in the measuring line shown in FIG. 5, and hence parts shown in FIG. 5 and like or corresponding to those shown in FIG. 3 are designated by the same reference characters and the further description thereof will be omitted.

The cleaning apparatus according to the present invention thus constructed cleans wafers W by immersing the wafers W in the cleaning liquid L contained in the inner tank 21 of the cleaning tank 20, supplying the cleaning liquid L from a cleaning liquid source, not shown, into the inner tank 21 so that the cleaning liquid L overflows the inner tank 21 into the outer tank 22, and filtering and circulating the cleaning liquid L collected in the outer tank 22. The fixed-quantity delivery pump 30 (or the fixed-quantity delivery pumps 30A and 30B) and the particle counter 50 are operated during or before starting a cleaning process to sample a fixed quantity of the cleaning liquid L from the inner tank 21 through the measuring line separate from the circulation line and to measure particles contained in the sample cleaning liquid L. The sample cleaning liquid L sucked through the particle counter 50 by the fixed-quantity delivery pump 30 is discharged through the discharge port 32 of the fixed-quantity delivery pump 30 and is returned into the outer tank 22 of the cleaning tank 20. Since the sample cleaning liquid L is not discharged into the inner tank 21 and is discharged into the outer tank 22, the cleaning ability of the cleaning liquid L contained in the inner tank 21 is not reduced and the cleaning liquid L can effectively used. The sample cleaning liquid may be discharged into a waste tank or the like instead of returning the same into the outer tank 22.

Figure 6:
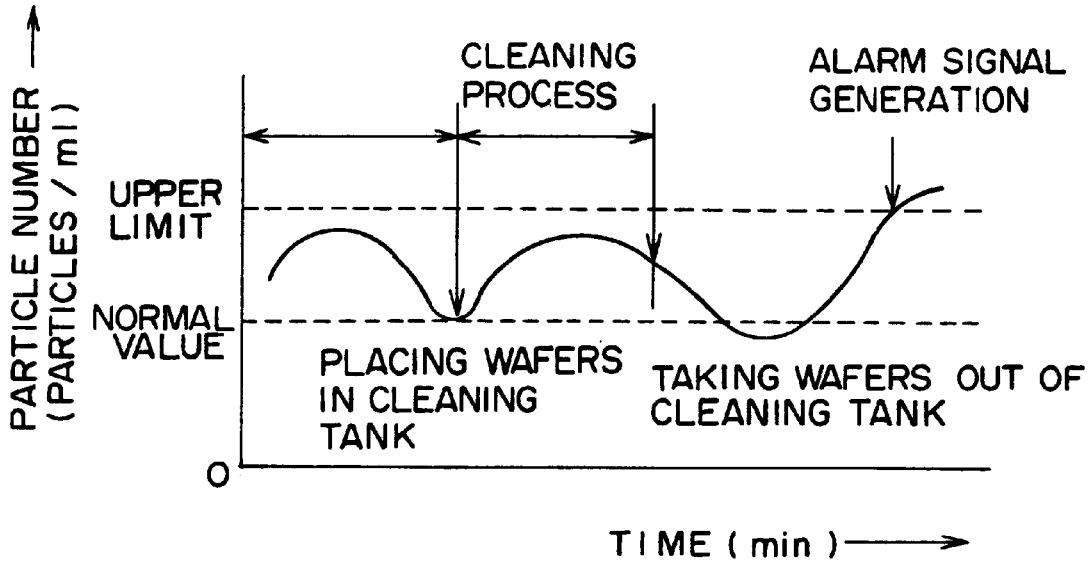
FIG. 6 is a graph showing the variation of the number of particles contained in a unit volume of the sample cleaning liquid with time.

The particle concentration (particle number) of the cleaning liquid L contained in the inner tank 21 is thus monitored. For example, the particle concentration of the cleaning liquid L is determined before starting a cleaning cycle, wafers W are carried into L the inner tank 21 and are subjected to the cleaning process if a detection signal provided by the CPU 60 indicates a particle concentration not greater than a predetermined upper limit particle concentration, such as 10 particles/ml as shown in FIG. 6. Thus, wafers W can efficiently be cleaned. If the detection signal provided by the CPU 60 indicates a particle concentration (particle number) exceeding the upper limit particle concentration of 20 particles/ml, the CPU 60 display an alarm to inform the operator of an inappropriate cleaning state.

Although the cleaning apparatus in the first embodiment has been described on an assumption that the cleaning liquid L is DHF, the particle concentration (particle number) of the cleaning liquid can be monitored even if the cleaning liquid L is a mixed liquid of ammonia and hydrogen peroxide (APM) or a mixed liquid of sulfuric acid and hydrogen peroxide (SPM).

Although the cleaning apparatus in the first embodiment has been described as applied to the semiconductor wafer cleaning system, needless to say, the cleaning apparatus is applicable to cleaning articles other than semiconductor wafers, such as glass substrates for forming LCDs and such.

As is apparent from the foregoing description, the cleaning apparatus in accordance with the present invention thus constructed has the following excellent effects.

A fixed quantity of the cleaning liquid can be sampled from the cleaning liquid contained in the cleaning tank, and particles contained in the sample cleaning liquid can accurately be counted by the measuring means. Therefore, the quality of the cleaning liquid can be monitored, the cleaning liquid of an optimum condition can be used for cleaning, so that the cleaning apparatus is able to operate at an improved yield and to exercise an improved cleaning ability.

A fixed quantity of the cleaning liquid can be sampled from the cleaning liquid contained in the cleaning tank, particles contained in the sample cleaning liquid can accurately be counted by the measuring means and measuring accuracy can be improved by synchronously operating the fixed-quantity delivering means and the measuring means.

A fixed quantity of the cleaning liquid can be sampled from the cleaning liquid contained in the inner tank in which workpieces are immersed in the cleaning liquid, and particles contained in the sample cleaning liquid can accurately be measured by the measuring means.

Since the sample cleaning liquid can be discharged into the outer tank instead of discharging the same into the inner tank in which workpieces are immersed in the cleaning liquid, the cleaning liquid can be circulated without deteriorating the cleaning ability of the cleaning liquid contained in the inner tank and the cleaning liquid can effectively used.

Since the durable, chemical-resistant motor-operated bellows pump capable of metering the cleaning liquid can be employed as the fixed-quantity delivering means, the life of the cleaning apparatus can be extended, and the measuring accuracy of the measuring means and the reliability of the cleaning apparatus can be improved.

Since the durable, chemical-resistant motor-operated bellows pump capable of metering the cleaning liquid can be employed as the fixed-quantity delivering means, the life of the cleaning apparatus can be extended, measuring accuracy of the measuring means and the reliability of the cleaning apparatus can be improved, and particles contained in a large quantity of the cleaning liquid can continuously and accurately be measured.

Second Embodiment

A cleaning apparatus in a second embodiment according to the present invention is substantially identical with the cleaning apparatus in the first embodiment shown in FIGS. 1 to 6, except that the former carries out a cleaning method different from that carried out by the latter. Parts of the second embodiment like or corresponding to those of the first embodiment shown in FIGS. 1 to 6 are designated by the same reference characters and the description thereof will be omitted.

Figure 7:
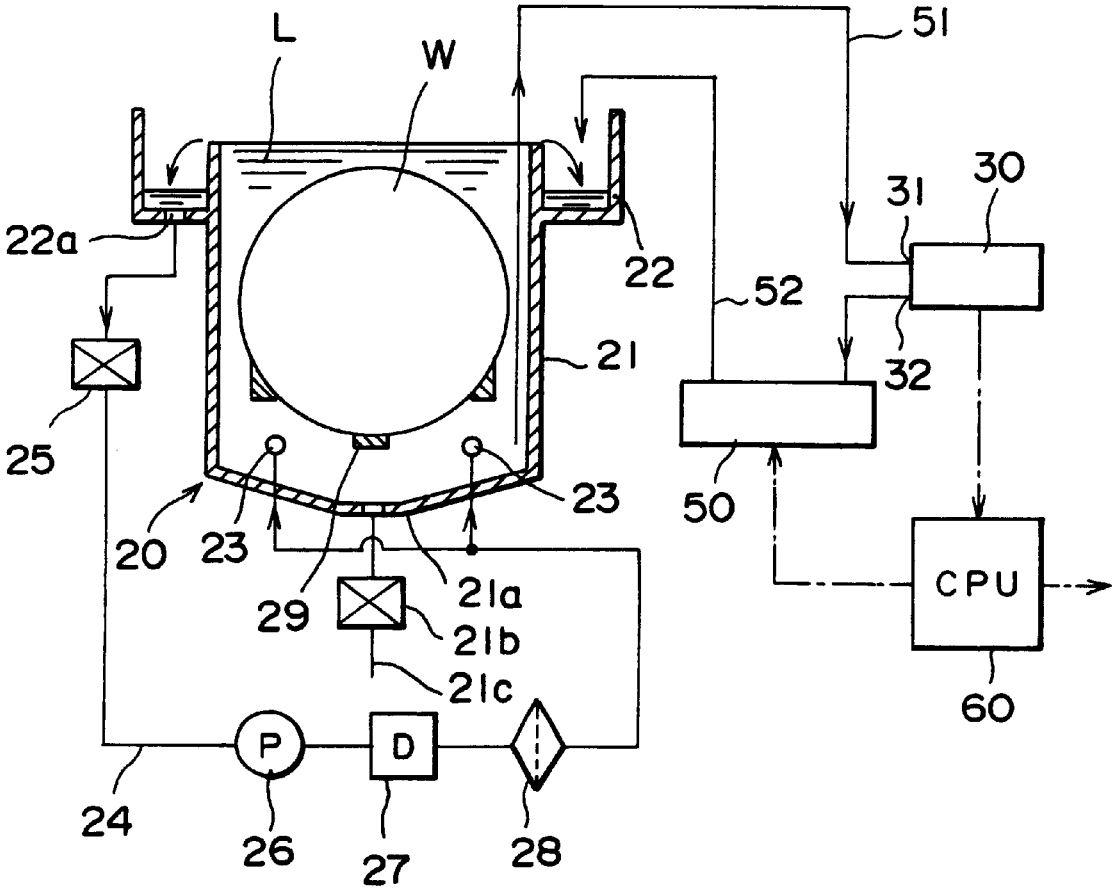
FIG. 7 is a schematic sectional view of a cleaning apparatus in a second embodiment according to the present invention.

In FIG. 2, the particle counter 50 is connected to the suction port 31 of the fixed-quantity delivery pump 30. However, the particle counter 50 need not necessarily be placed on the suction pipe 51 connected to the suction port 31 of the fixed-quantity delivery pump 30, but may be placed on a discharge pipe 52 connected to the discharge port 32 of a fixed-quantity delivery pump 30 as shown in FIG. 7. When the particle counter 50 is placed in the discharge pipe 52 connected to the discharge side of the fixed-quantity delivery pump 30, the sample cleaning liquid L sampled from the cleaning liquid L contained in an inner tank 21 is prevented from bubbling.

The cleaning apparatus shown in FIG. 7 is the same in construction and function as the cleaning apparatus shown in FIG. 2, except that the particle counter 50 is connected to discharge side of the fixed-quantity delivery pump 30 in the cleaning apparatus shown in FIG. 7 and hence the further description of the cleaning apparatus shown in FIG. 7 will be omitted.

In either the cleaning apparatus shown in FIG. 2 or the cleaning apparatus shown in FIG. 7, wafers W are immersed in the cleaning liquid contained in the inner tank 21 of the cleaning tank 20, the cleaning liquid L is supplied from the cleaning liquid source, not shown, into the inner tank 21 so that the cleaning liquid L overflows the inner tank 21 into the outer tank 22, and the cleaning liquid collected in the outer tank 22 can be filtered and circulated while the wafers W are being cleaned. The fixed-quantity delivery pump 30 and the particle counter 50 are operated during or before starting a cleaning process to sample a fixed quantity of the cleaning liquid L from the inner tank 21 through the measuring line separate from the circulation line and to measure particles contained in the sample cleaning liquid L. The sample cleaning liquid L sucked through the particle counter 50 and discharged through the discharge port 32 of the fixed-quantity delivery pump 30 or the sample cleaning liquid discharged through the discharge port 32 of the fixed-quantity delivery pump 30 into the particle counter 50 is returned into the outer tank 22 of the cleaning tank 20 to use the sample cleaning liquid again for cleaning. Thus, the cleaning liquid can effectively used. The sample cleaning liquid may be discharged into a waste tank or the like instead of returning the same into the outer tank 22.

Figure 8:
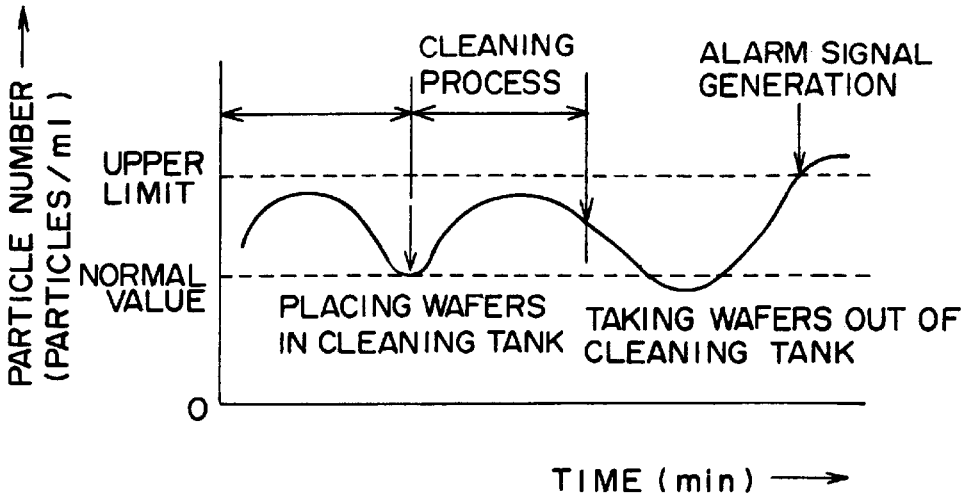
FIG. 8 is a graph showing the variation of the number of particles contained in a unit volume of the sample cleaning liquid with time.

A cleaning method in accordance with the present invention will be described hereinafter with reference to FIGS. 8 to 12. In step A (FIG. 12), the fixed-quantity delivery pump 30 and the particle counter 50 are operated during or before starting a cleaning process to sample a fixed quantity of the cleaning liquid L from the inner tank 21 through the measuring line separate from the circulation line and to measure particles contained in the sample cleaning liquid L. If a particle concentration (particles/ml) determined on the basis of the number of particles counted by the particle counter 50 is greater than the upper limit particle concentration of, for example, 20 particles/ ml, as shown in FIG. 8, the CPU 60 provides an alarm signal to inform the operator of an inappropriate cleaning condition (steps B and C). When the CPU 60 provides an alarm signal, the operator replaces the old cleaning liquid L with the new cleaning liquid L by discharges the old cleaning liquid L from the cleaning tank 20 and supplying the new cleaning liquid L into the cleaning tank 20 before staring the next cleaning cycle. The cleaning liquid L may be changed when the alarm signal provided by the CPU continues longer than a predetermined time. The cleaning liquid L is changed if the particle concentration of the cleaning liquid L does not decrease below the upper limit particle concentration before starting a cleaning cycle.

The alarm signal provided by the CPU may be interpreted as a cleaning liquid change request signal or an abnormal wafer indication signal.

Figure 9:
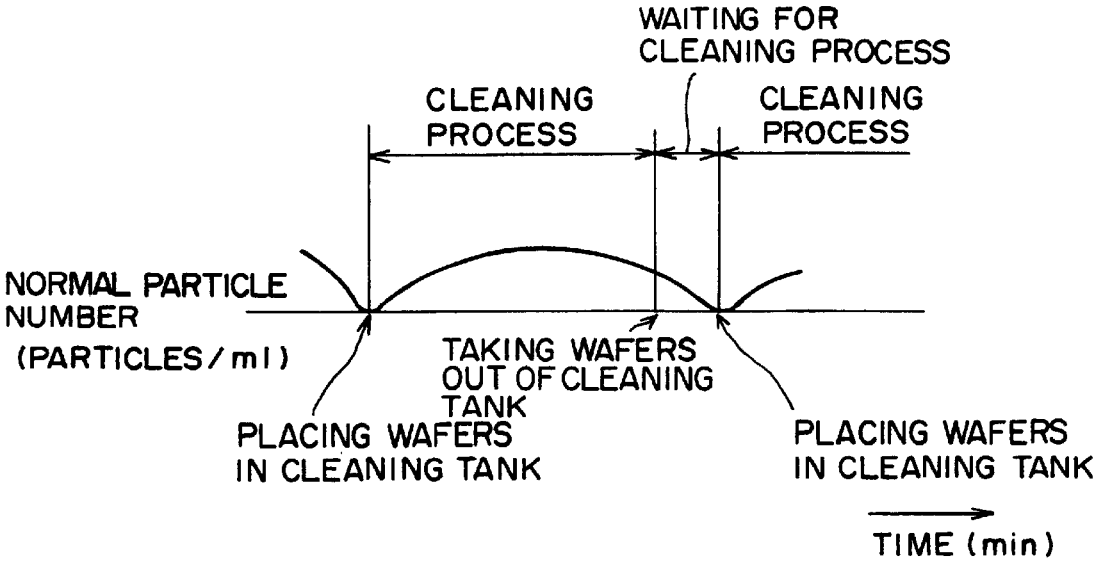
FIG. 9 is a diagram of assistance in explaining a method of timing the start of a cleaning cycle.
Figure 10:
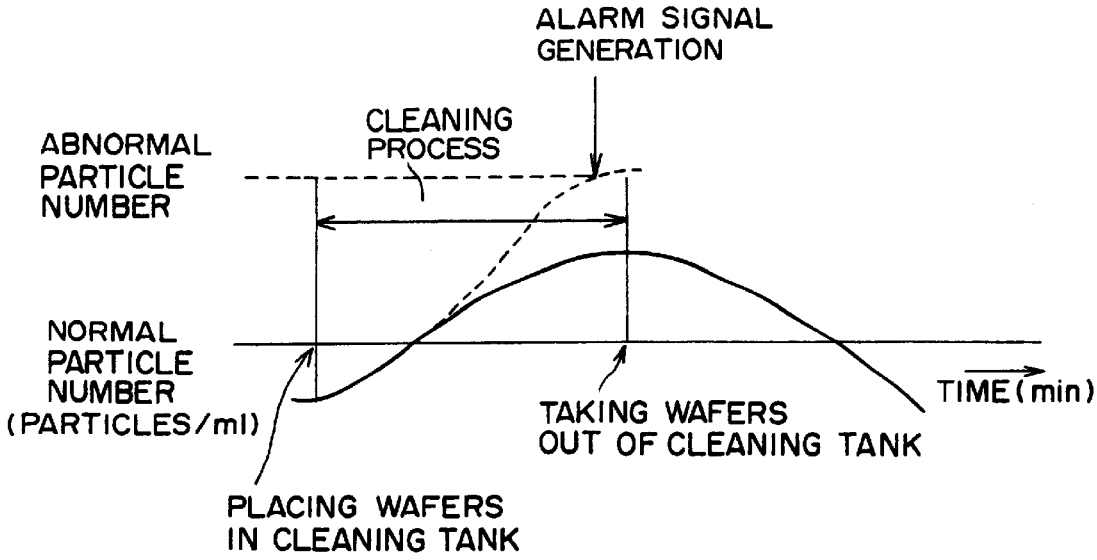
FIG. 10 is a diagram showing the occurrence of an abnormal state during a cleaning cycle.
Figure 11:
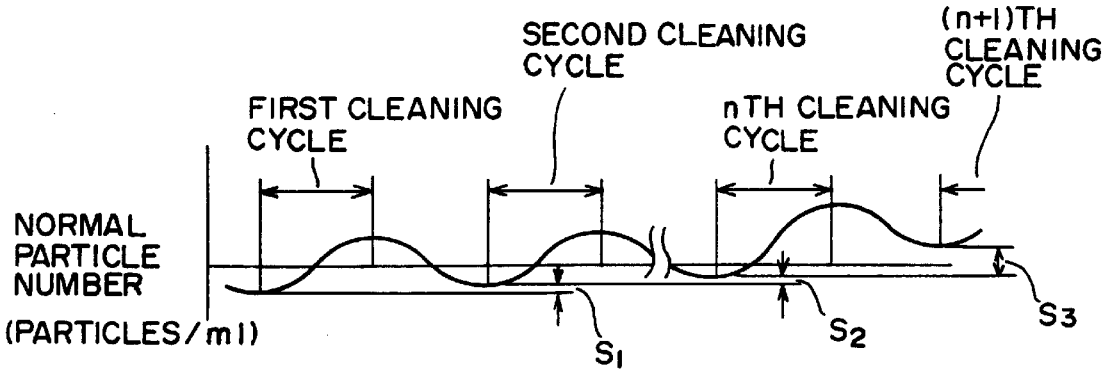
FIG. 11 is a diagram showing the effect of filtering on the variation of differential particle quantity.
Figure 12:
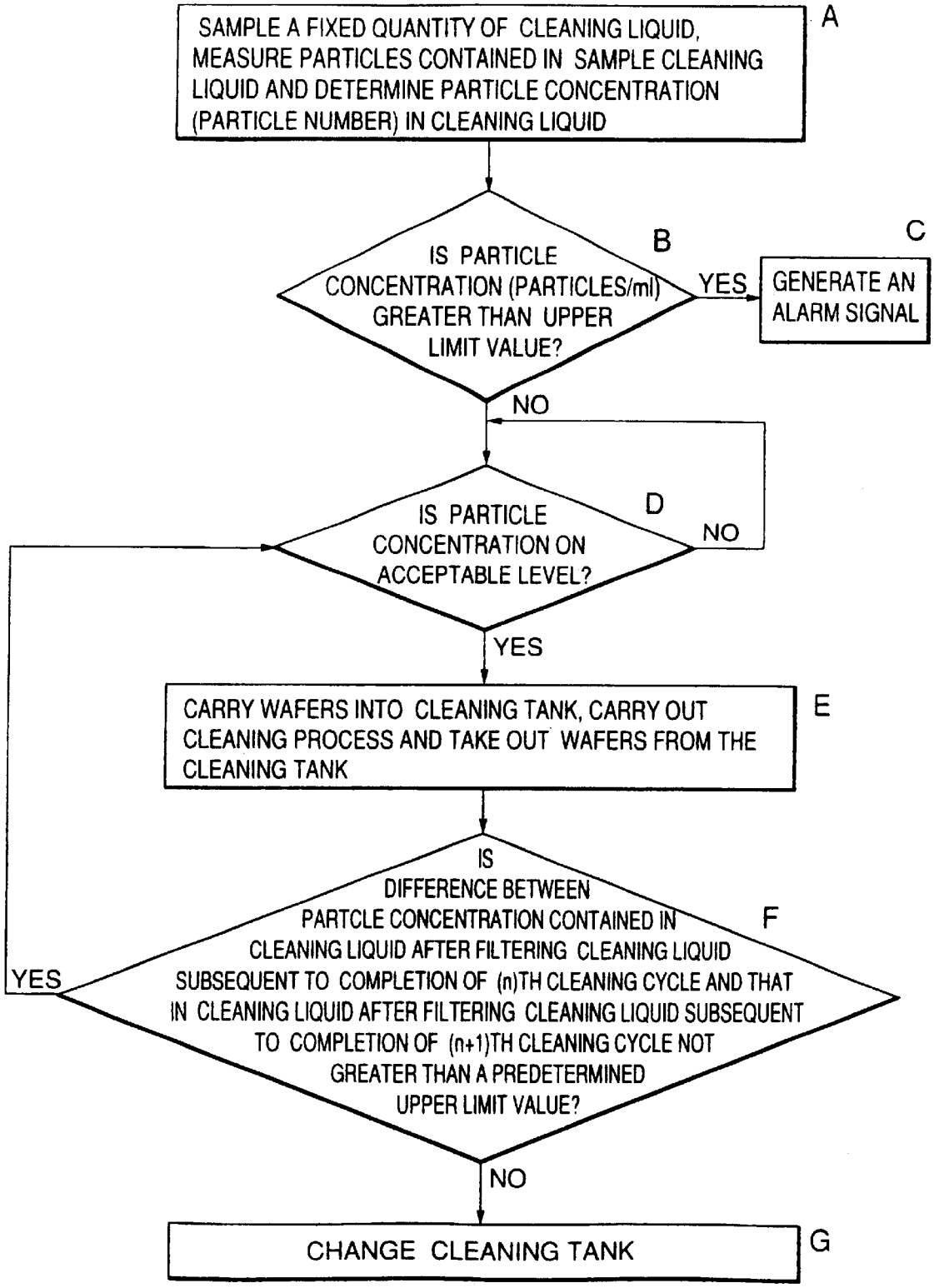
FIG. 12 is a flow chart of a cleaning process.
Figure 13:
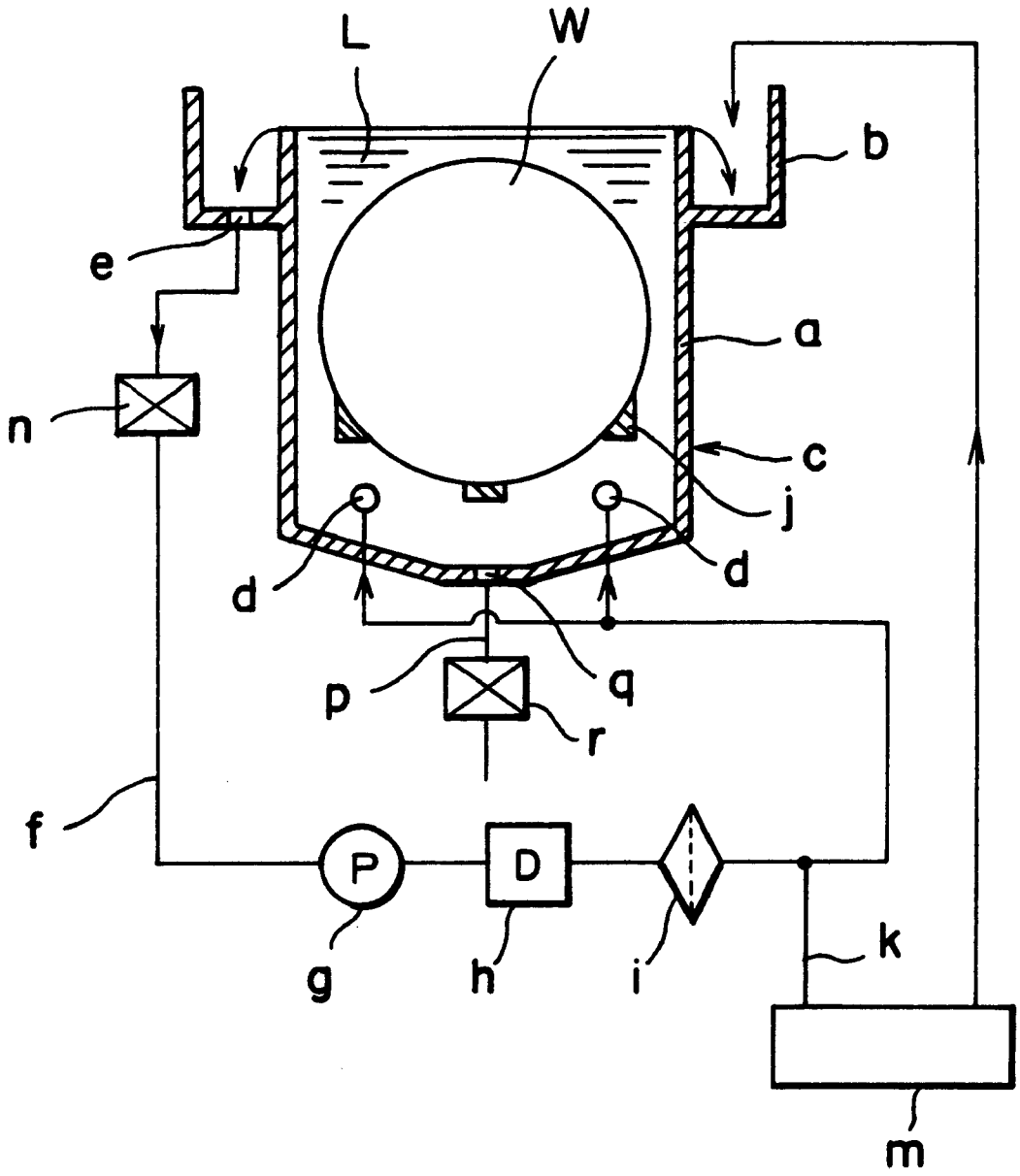
FIG. 13 is a schematic sectional view of a conventional cleaning apparatus.

If the measured particle concentration (particle number) is not greater than the upper limit particle concentration (particle number) and is on an acceptable level as shown in FIG. 8, wafers W are carried into the cleaning tank 20, more specifically, into the inner tank 21, the cleaning liquid L is supplied from the cleaning liquid source, not shown, into the inner tank 21 so that the cleaning liquid L overflows the inner tank 21, the cleaning liquid L overflowing from the inner tank 21 is filtered and circulated while the wafers W are subjected to a cleaning process for a predetermined cleaning time, such as 10 min (steps D and E). The wafers W are carried out of the cleaning tank 20 after the elapse of the cleaning time. After the wafers W have been taken out of the cleaning tank 20, the cleaning liquid L contained in the cleaning tank 20 is circulated through the circulation line while particles contained in the cleaning liquid L are filtered out. A plurality of wafers W such as fifty wafers W, are carried into the cleaning tank 20 for the next cleaning cycle after the particle concentration of the cleaning liquid L has been decreased to an acceptable level as shown in FIG. 9. Then, the next cleaning cycle is executed. During the cleaning process, the cleaning liquid L contained in the inner tank 21 is sampled, and the number of particles contained in the sample cleaning liquid L is measured by the particle counter 50. If the particle concentration increases extraordinarily beyond the upper limit particle concentration during the cleaning process, the CPU 60 provides an alarm signal as shown in FIG. 6 to inform the operator of the abnormal condition, and the cleaning process is interrupted.

The CPU 60 may compare a particle concentration (particle number) measured before starting the first cleaning cycle and a particle concentration (particle number) measured after the completion of every cleaning cycle, and may provide an alarm signal if the difference between the particle concentration measured before starting the first cleaning cycle and the particle concentration measured after the completion of every cleaning cycle exceeds a predetermined upper limit value. The operator is able to perceive that the wafers W being cleaned are abnormal from the alarm signal provided by the CPU 60, and the abnormal wafers W can be discriminated and separated from normal wafers.

A plurality of cycles of the cleaning process are carried out to clean a plurality of lots of wafers W. Particles contained in the cleaning liquid L are counted by the particle counter 50 during the plurality of cycles of the cleaning process, and the differences S1, S2 and S3 (FIG. 11) between the particle concentrations measured in the successive cleaning cycles may be calculated. If the difference is greater than a predetermined upper limit value, such as the difference S3 (FIG. 11), the cleaning liquid L is changed (steps F and G). The cleaning liquid L may be changed when the difference between a particle concentration of the cleaning liquid L at the start of the nth cleaning cycle and a minimum particle concentration of the cleaning liquid L reached after the completion of the nth cleaning cycle is greater than a predetermined upper limit value. A number of cleaning cycles to be carried out or a period for which the cleaning process can be carried out before changing the cleaning liquid L may be determined beforehand on the basis of experimental data, and it is possible to change the cleaning liquid L at optimum time by referring to the predetermined number of cleaning cycles or the predetermined time.

Although the cleaning method in accordance with the present invention has been described on an assumption that the cleaning liquid L is DHF, the particle concentration of the cleaning liquid can be determined and the quality of the cleaning liquid L can be monitored even if the cleaning liquid L is a mixed liquid of ammonia and hydrogen peroxide (APM) or a mixed liquid of sulfuric acid and hydrogen peroxide (SPM).

Although the cleaning method in accordance with the present invention has been described as applied to the semiconductor wafer cleaning system, needless to say, the cleaning method is applicable to cleaning articles other than semiconductor wafers, such as glass substrates for forming LCDs and such.

According to the present invention, a fixed quantity of the cleaning liquid contained in the cleaning tank is sampled from a part other than the circulation line before starting a cleaning process or during the cleaning process; and the quantity (particle number) of contaminative particles contained in the cleaning liquid is measured. Therefore, contaminative particles contained in the cleaning liquid can accurately be measured, and it is possible to inform the operator of an inappropriate condition of the cleaning liquid by a detection signal indicating a quantity of contaminative particles exceeding a predetermined upper limit value. Consequently, the cleaning liquid can be maintained in a quality suitable for cleaning, and cleaning ability and yield can be improved. It is also possible to inform the operator that the quantity of contaminative particles contained in the cleaning liquid is not greater than the predetermined upper limit value and the normal cleaning process can be achieved.

Since a fixed quantity of the cleaning liquid contained in the cleaning tank is sampled from a part other than the circulation line and the quantity of contaminative particles contained in the sample cleaning liquid is measured, the quantity of contaminative particles contained in the cleaning liquid can accurately be measured, and the cleaning liquid is changed if particle concentration of the cleaning liquid decreases below the predetermined upper limit value to improve the ability and the yield of the cleaning process.

Since a fixed quantity of the cleaning liquid contained in the cleaning tank is sampled from a part other than the circulation line and the quantity of contaminative particles contained in the sample cleaning liquid is measured, the quantity of contaminative particles contained in the cleaning liquid can accurately be measured, and the cleaning ability of the cleaning liquid and yield can be improved by changing the cleaning liquid if the difference between the particle concentration of the cleaning liquid before starting the first cleaning cycle and that of the cleaning liquid after the completion of a cleaning cycle is greater than a predetermined upper limit value.

Since a fixed quantity of the cleaning liquid contained in the cleaning tank is sampled from a part other than the circulation line and the quantity of contaminative particles contained in the sample cleaning liquid is measured, the quantity of contaminative particles contained in the cleaning liquid can accurately be measured, and the cleaning ability of the cleaning liquid and yield can be improved by changing the cleaning liquid if the difference between the particle concentration of the cleaning liquid before starting a cleaning cycle and that of the cleaning liquid after the completion of the same cleaning cycle is greater than a predetermined upper limit value.

The cleaning liquid can properly be changed and the cleaning ability of the cleaning liquid and yield can be improved by determining time for changing the cleaning liquid on the basis of a predetermined number of cleaning cycles to be carried out or a predetermined period for which the cleaning process may be carried out before changing the cleaning liquid, and the measured particle concentration of the cleaning liquid.

What is claimed is:

1. A cleaning apparatus comprising:

a cleaning tank for containing a cleaning liquid in which a workpiece is immersed for processing;

a circulation line connected to the cleaning tank and provided with a filtering device;

a measuring line separate from the circulation line, said measuring line provided with a fixed-quantity delivery means for delivering a fixed-quantity of cleaning liquid in the measuring line, a measuring means for measuring the number of fine contaminative particles contained in the fixed-quantity of cleaning liquid, and a suction end connected to the cleaning tank; and a control means for synchronously operating said fixed-quantity delivery means and said measuring means so that the number of fine contaminative particles contained in said fixed-quantity of cleaning liquid are measured by said measuring means.

2. The cleaning apparatus according to claim 1, wherein the measuring means is connected to a suction side of the fixed-quantity delivery means.

3. The cleaning apparatus according to claim 1, wherein the measuring means is connected to a discharge side of the fixed-quantity delivery means.

4. The cleaning apparatus according to claim 1, wherein the control means controls the measuring means and the fixed-quantity delivery means so that the measuring means carry out a measuring operation while the fixed-quantity delivery means is in suction operation.

5. The cleaning apparatus according to claim 1, wherein a discharge end of the measuring line is connected to the cleaning tank.

6. The cleaning apparatus according to claim 1, wherein the cleaning tank includes an inner tank in which the workpiece is immersed in the cleaning liquid, and an outer tank for containing the cleaning liquid overflowing from the inner tank, and wherein a suction side of the measuring line is connected to the inner tank.

7. The cleaning apparatus according to claim 6, wherein a discharge side of the measuring line is connected to the outer tank.

8. The cleaning apparatus according to claim 1, wherein the fixed-quantity delivery means is a motor-operated bellows pump comprising a corrosion-resistant and chemical-resistant bellows, and a ball screw mechanism for driving the bellows.

9. The cleaning apparatus according to claim 1, wherein the fixed-quantity delivery means comprises a plurality of motor-operated bellows pumps arranged in parallel, and the bellows pumps are driven so that the bellows pumps operate in different phases, respectively.

10. The cleaning apparatus according to claim 1, wherein the control means provides a detection signal when the measured contaminative particle number of the cleaning liquid exceeds a predetermined limit value.

* * * * *